US005451050A

United States Patent [19]

Charles

[11] Patent Number: 5,451,050

[45] Date of Patent: Sep. 19, 1995

[54] INTERACTIVE BOARD GAME

[76] Inventor: Eric Charles, 219 Beech St., Bakersfield, Calif. 93304

[21] Appl. No.: 158,263

[22] Filed: Nov. 29, 1993

[51] Int. Cl.[6] ..... A63F 7/06; A63F 7/40

[52] U.S. Cl. ..... 273/94; 273/247; 273/128 R; 273/243

[58] Field of Search ..... 273/94, 244, 259, 146, 273/243, 247, 128 R

[56] References Cited

U.S. PATENT DOCUMENTS

| | | | |
|---|---|---|---|
| 516,789 | 3/1894 | Hillis | 273/94 |
| 563,767 | 7/1896 | Holland | 273/94 |
| 600,738 | 3/1898 | McClure | 273/94 |
| 1,331,196 | 2/1920 | Hart | 273/94 |
| 1,537,605 | 5/1925 | Hansen | 273/94 |
| 1,603,717 | 10/1926 | Rubino | 273/94 |
| 1,613,530 | 1/1927 | Peterson | 273/94 |
| 2,245,830 | 6/1941 | Sheffield | 273/94 |
| 2,743,105 | 4/1956 | Westbrook | 273/94 |
| 4,872,679 | 10/1989 | Bohaski | 273/94 |
| 5,110,127 | 5/1992 | Potter | 273/94 |
| 5,186,461 | 2/1993 | Tucker | 273/94 |
| 5,257,783 | 11/1993 | Callaghan | 273/94 |

*Primary Examiner*—Sebastiano Passaniti
*Attorney, Agent, or Firm*—Dennis B. Haase

[57] ABSTRACT

The present invention relates to apparatus for an interactive board game which closely resembles American football, together with the method of playing the game. A game board is included which is marked off with hash marks in a manner similar to American football, distinguished primarily by the presentation of a penalty zone in the center of the board separating two 50-yard fields of play. Game pieces, which closely resemble figurines in football dress, represent opposing teams which are moved in accordance with instructions on game cards or, alternatively, by the number on dice, and a missile, configured to have the general appearance of a football is used for field goals and extra points, such as by flicking the missile with one's finger from a predetermined position to project the missile through opposing goal posts.

21 Claims, 3 Drawing Sheets

FIG. 4A. Starting Play
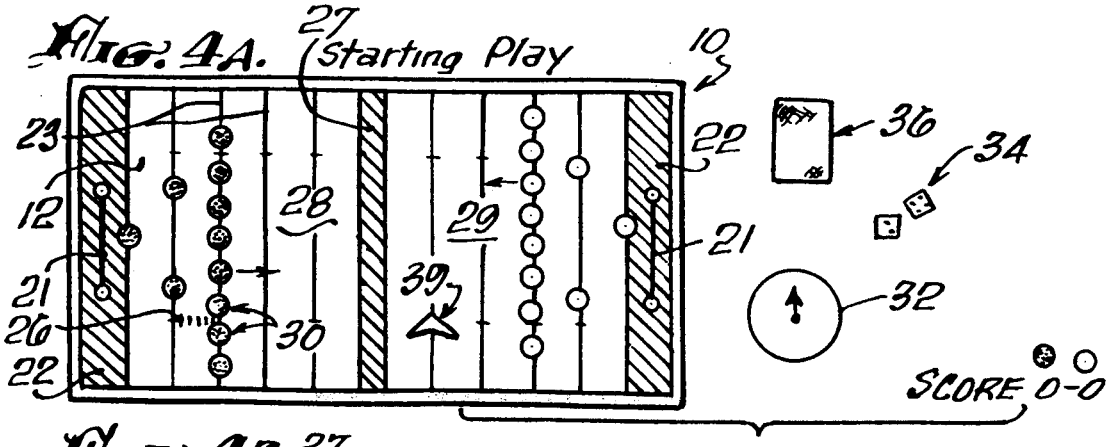
FIG. 4B. First Quarter
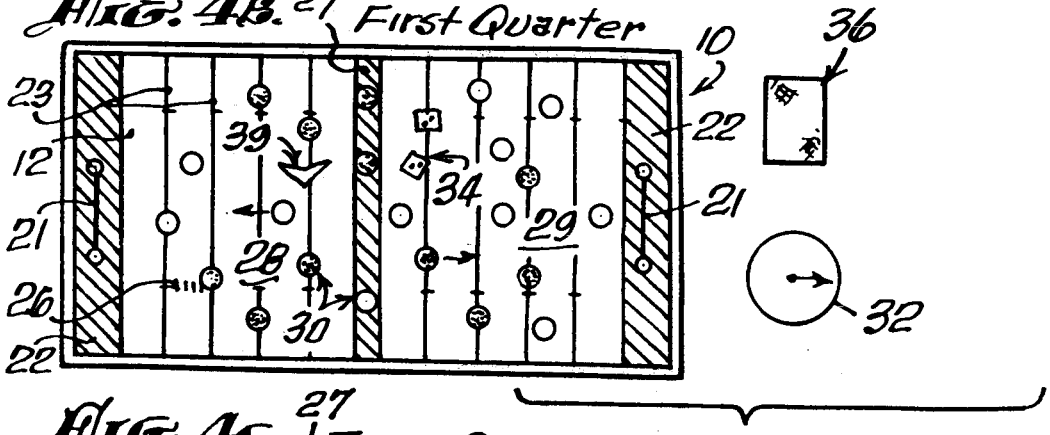
FIG. 4C. THIRD QUARTER
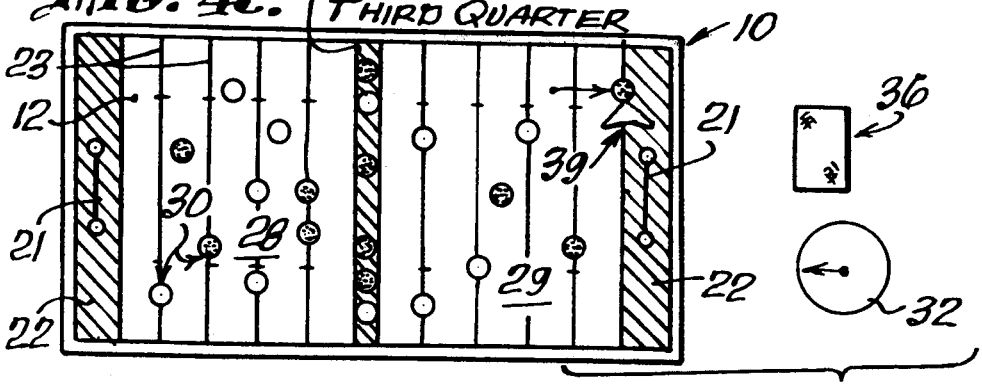
FIG. 4D. GAME OVER
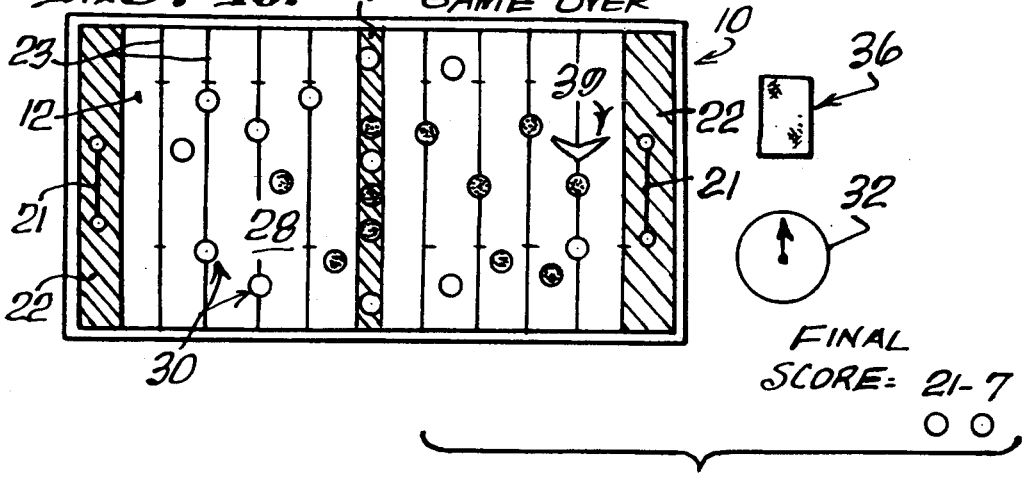

INTERACTIVE BOARD GAME

The present invention relates generally to board games which simulate sporting events such as, for example, football, and consitutes a marked improvement over existing games in that there is more action than simply rolling dice and moving game pieces, thereby giving players and spectators alike a greater feel of action within the game itself.

BACKGROUND OF THE INVENTION

Field of the Invention

At least since Parker Bros. brought Monopoly ® to the public, there has been a fascination with board games, and particular those games which tend to simulate human experience. Whether the game is high finance, or a sporting event, the board game becomes the player's fantasy, and the successful games are those that permit the player to step outside himself or herself and for a few precious moments, become someone, or something, which would not otherwise be possible in the real world.

Football, at least in the United States, is a high profile sport which millions watch, some with a passion, while only a limited few can actually play. There is a strategy to the game which has been chronicled in enough books to fill a small library. There are movies, highlight films, training films and videos of every description, all of which have as a goal, putting the viewer in the middle of the action.

Overview of the Prior Art

Games are a release for most, and football games abound, because it is the consummate spectator sport in the United Sates, and because so many who watch, dream of playing.

Existing simulation "football" games come in a variety of forms ranging from pinball machines to miniature computerized versions, most of which require auxiliary devices, for example, television monitors, to play the game.

Board games will always be popular in that they tend to involve more people, and tend not to require any particular physical skills or coordination to play.

Some games which use a board also require batteries or some electrical hookup. Such games are outside the scope of the present invention. Still others may pretend to simulate a game such as football, they are, in reality, nothing more than a dart game, for example, and Sheen U.S. Pat. No. 4,681,325 is exemplary of the pretenders.

Godwin U.S. Pat. No. 4,173,346 is exemplary of the type of board game to which the present invention pertains, and over which it is a quantum leap, in strategy, fun, and to a very limited extent, a modicum of physical skill. In Godwin, as in most board type games, whether or not football related, the common demoninator is to roll the dice, move a game piece, or turn a card. While the present invention has those features, they are combined in a unique array of options, and there is more, as a reading of the detailed description presented hereinafter will make abundantly clear.

SUMMARY OF THE INVENTION

Football is a game of strategy in which the clock often governs the play. One of the many fascinations with the game is that there are several ways to score, and there are different point values assigned to various scoring modes. As in the game on the field, so too does the present invention provide scoring options such as touchdowns, field goals, and extra points.

Unlike any other game the players have experienced, however, it is an objective of the present invention to "put the player in the game, on the field of play", as he "kicks" his own field goals and extra points.

It is another objective of the present invention to force each player to govern his or her strategy by time. In so doing, the present invention actually puts the clock on each play, and the length of the game also is governed by the clock. Thus, each player must analyze his position, vis-a-vis the time remaining, and do what he must do to defend, or advance the ball.

Still another objective of the present invention is to provide each player with realistic options on virtually every play, involving each of the eleven men initially allocated to him or her, thereby making the decision making process very similar to that which a coach is required to make on every down.

Finally, part of the fun of the game is the realism of having eleven men who look like players, and not checkers, who play on a field that has a realistic appearance, and who are moved much as one playing the game might move.

There are other objectives, of course, which will become apparent as this specification unfolds.

DESCRIPTION OF THE DRAWINGS.

FIGS. 4A through 4D illustrate some patterns and moves typically experienced during play, which aid in understanding the game.

DESCRIPTION OF A PREFERRED EMBODIMENT

Figures 1, 2:
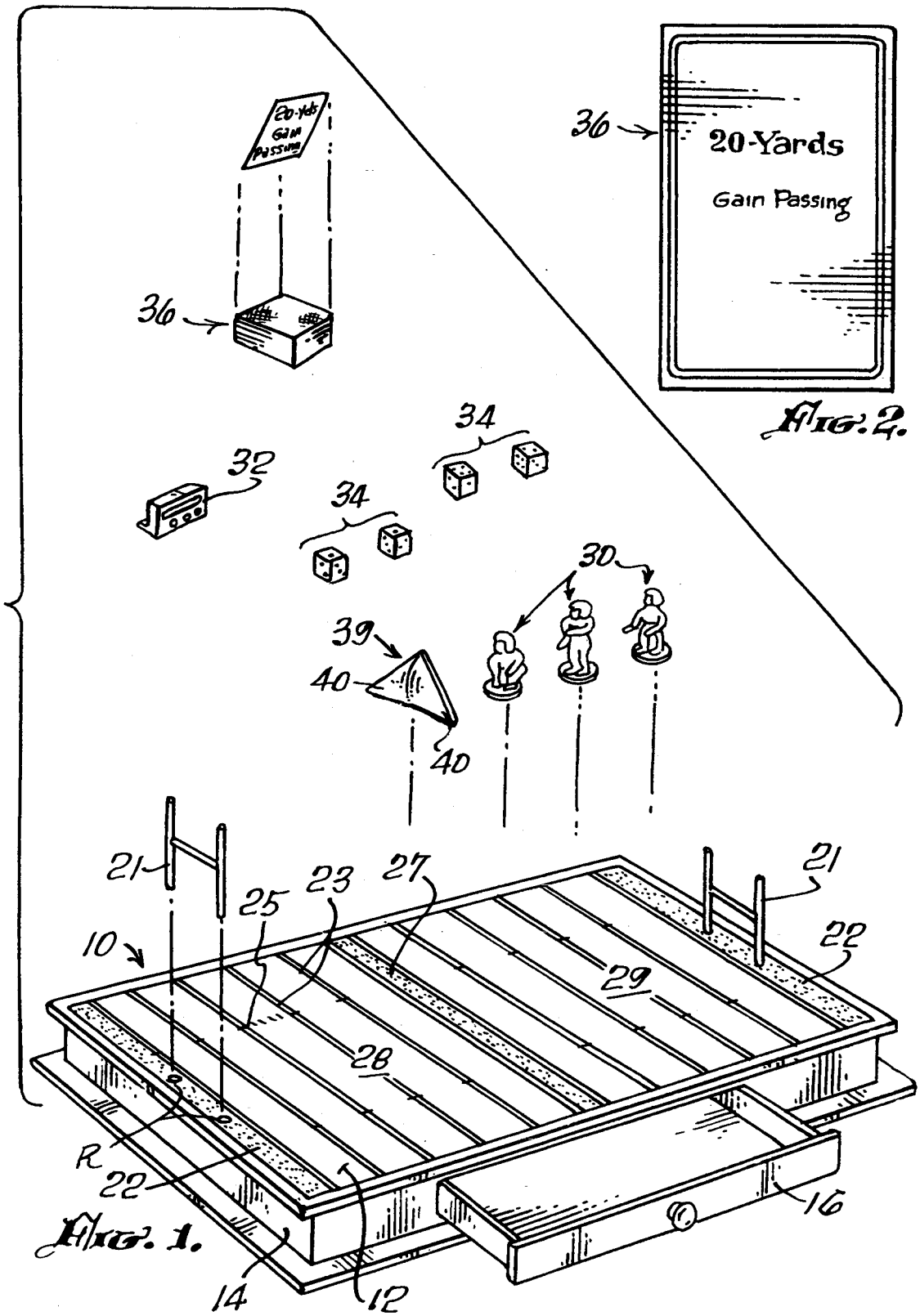
FIG. 1 is a pictorial representation of the game board, men, and playing tools available to each player.
FIG. 2 depicts a game card with one of its options illustrated.

With reference now to the drawings, and initially to FIG. 1 the various physical elements which make up the "tools" of the game, constructed in accordance with the present invention, are illustrated.

Primary to those elements is the game board 10, which, as shown, comprises a playing field 12. In its illustrated form, the playing field is formed on the top of a convenient cabinet 14, having a drawer 16 which will hold the remaining physical elements indigenous to the game. Clearly, a more simplified game board with a field of play can be used, and indeed, one far more elaborate, and neither would detract from the fun of the game.

The game board is complimented by the provision of upstanding goal posts 21. The goal posts are at the remote end lines 22, of a field of play, marked off to indicate one hundred yards of play, punctuated by yard stripes 23, indicating ten yard intervals, and hash marks 25, which because of size constraints, signify two yard intervals. A penalty zone 27 is created at center field, the significance of which will soon become apparent. The penalty zone divides the field of play into two opposed fifty yard sections 28 and 29, representing the offensive and defensive sides of the field. Once again, where size is of no consequence, the hash marks may be used to signify one yard increments, and five yard stripes may be included, all without eftacting the charm of the game.

Also, while the more traditional "H" shaped goal posts are shown, the single post "U" shaped goal may be readily used. Either way, receptacles in the game board at R, secure the goals in their upstanding position for play.

In its preferred form, play is enhanced by the provision of sculpted statuettes, as game pieces 30, all of which closely resemble uniformed football players. These game pieces are the players, and they give the game a look and feel which has no precedent in the board game art.

In order to make the game as realistic as possible, and to apply game type pressure to each player, the game is timed, and to that end, timer 32 is provided. The timer not only times quarters, but has the capability to time the interval between plays. Moreover, it can be stopped and started to realistically reflect time outs.

There are, in accordance with the invention, two sets of dice, 34, one for each team, which serve to assist the competitors in determining the order of play, and the nature of the play to be run. A stack of game cards 36, which are optionally selectable, are used to provide alternate play opportunities. The game cards 36 are specially designed to provide the players with options not otherwise found in the typical dice type game. Specifically, the cards available are as follows:

4 each - 5 yard passing and running
4 each - 10 yard passing and running
4 each - 15 yard passing and running
4 each - 20 yard passing and running
4 each - 30 yard passing and running
4 each - 40 yard passing and running
4 each - 50 yard passing and running
4 only - field goal card
4 only - sacked quarterback
4 only - interception card
4 only - stopped the run
4 only - incomplete pass card
4 only - stay card
4 only - delay of game card
4 only - no gain card
4 only - second chance card
4 only - fumble card
4 only - clipping card
4 only - face mask card
4 only - first down card
4 only - loss of down card
4 only - illegal use of hands
4 only - cancel card
1 only - overtime card Finally, realism is further served by the provision of a useable missile or projectile, 39. The shape of the missile resembles a football and is roundish in cross section, but tends to be more triangular in profile, having pointed ends 40, making it more readily adaptable for use in kicking field goals and extra points in restricted spaces inevitably found in living rooms and play areas where games of the type illustrated here are most often played.

Perhaps the best way to understand the unique qualities of the present invention is to run through some of the plays that one will encounter over the course of a game.

Figure 3:
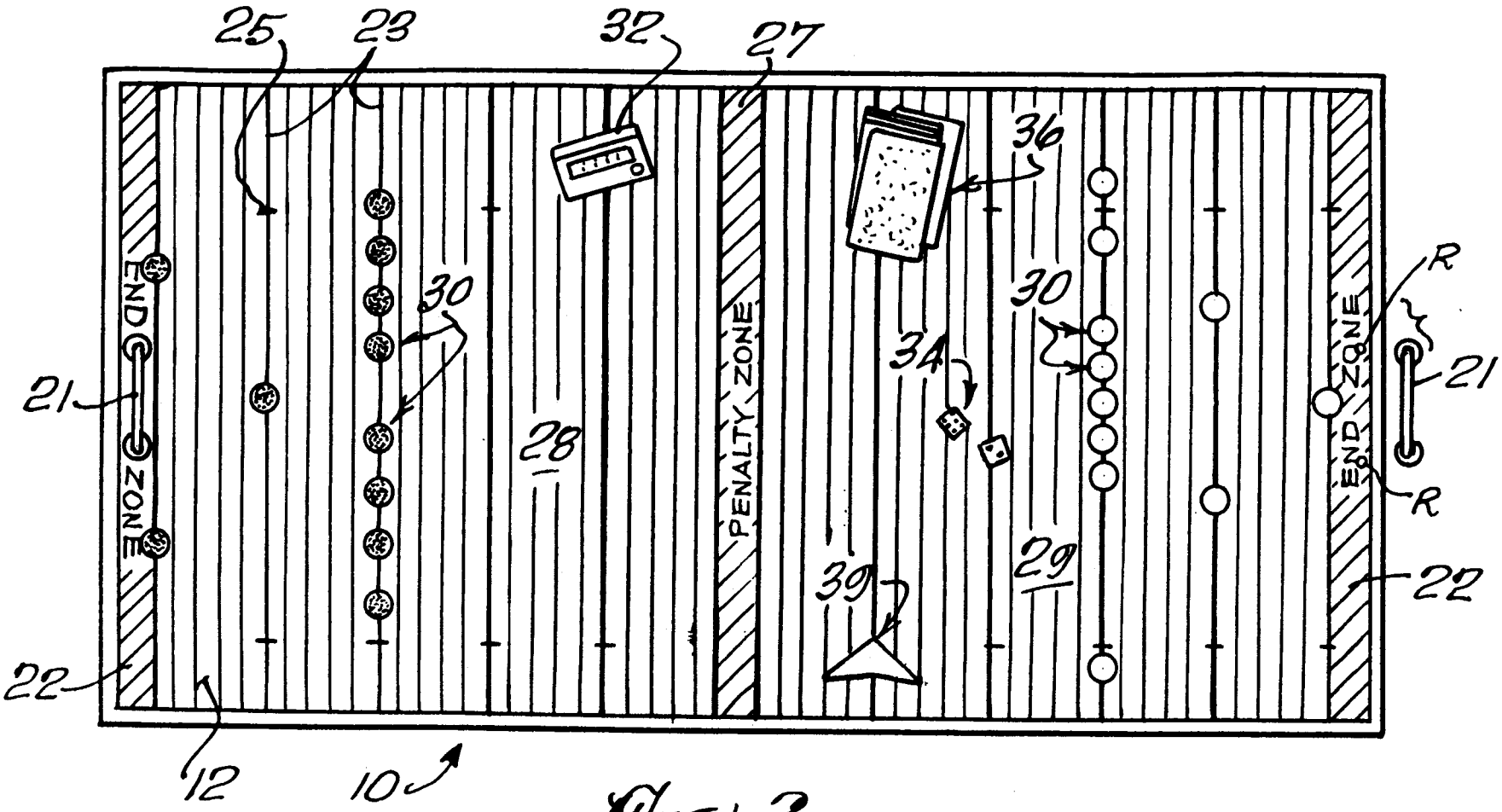
FIG. 3 depicts the game board with the teams in formation ready for the initial play.

Play is initiated by rolling the dice. Players 30 for both teams are initially aligned with eight players 30 on each team's twenty yard stripe. Each player then has the option of placing the remaining three players at strategic points behind the front line. In FIG. 3, for example, there is one on the ten and two on the goal at one end, while the other team chose an opposite pattern at the other. Other combinations may be used, but always keeping in mind that no player can move rearwardly. Therefore, if an offensive player gets behind one's last line of defense, that player has an unrestricted path to the end zone. Prudence dictates, therefore, that some defensive players be situated in strategic places close to the end zone.

As in the real life game, defense is as important as offense, and the dominant rule of the game for the defensive minded is that if a defensive player can be advanced to the same yard line as an advancing offensive player, the offensive player is "tackled" and knocked back to one of two points. If the offensive player is over the fifty yard line and into his opponent's territory, he is knocked back to the penalty area 27. If the player is not yet to the fifty, upon being tackled, he is returned to the point from which he started, typically, his own twenty yard stripe.

The player, who on the initial toss, rolled the high total on the dice, rolls the dice, the clock 32 is started, and let the game begin.

If the initiating offensive team rolls a double, it has three play options: first, it is entitled to a game card; or to move one of its players 30 a number of yards equal to the full count on both of the dice, or, finally, it can move two players, each a number of yards equal to the count on one die.

A fourth option, not considered a play option, is to free a player from the penalty zone, who then advances by the count shown on the dice. It will be apparent that the fourth option can provide a significant offensive boost to a team that has not been able to advance its players into good offensive position, and it is always a consideration in defensive strategy. The offense must decide whether its reserve of game cards is sufficient that advancing a player from the penalty area is more valuable than another card, or some other move.

For example, if two fours are rolled, the team may take a game card, move one player eight yards, or it may move two players four yards each.

If a game card is selected, it may, in most instances be played at the holder's convenience in lieu of shaking the dice. Some cards, however, must be played at once, such as, for example, the "loss of down" card. Such a card causes the unlucky holder to miss its next turn. Once played, a game card 36 is discarded and unusable for the remainder of the game.

Cards, in accordance with this novel game, which do not require immediate play, are held in reserve and may be played at any time in lieu of rolling the dice. In accordance with the rules of play, a player may score by using a card which will put him in the end zone (but not through the end zone), from his present location. A player that is thirty yards from the end zone may use a thirty yard pass to score. If he is on the twenty, the thirty yard pass will put him out of the end zone and the play returns. Moreover, if the defense is holding a card which will nullify the pass, the player comes back. All cards used are discarded for the remainder of the game.

If the field goal card is chosen, the holder must then look to the clock, the score, and the relative position of his players 30. If all of these factors dictate the need for a quick score, the card holder may elect to play the card.

A field goal attempt is made, in accordance with the invention, by placing the football 39 on the game board behind the end zone of the kicking team and by standing the football on one of its pointed ends and holding it upright with one finger. The ball is then struck, or flicked, with another finger to send it sailing through the opponent's goal posts . . . three points. Extra points are, of course, attempted in the same manner for one point.

Strategy dictates that some players 30 advance while others remain in strategic defensive positions to protect the team's end zone. Typically, therefore, a stagger line, such as that shown in FIG. 4B is good strategy because it puts the defense in a position to tackle oncoming offensive players.

This raises another matter which should be addressed at this time. While in the real world a team gets four downs, and first downs, it has been found in this game world that more than two consecutive downs often gives a team an inordinate advantage, primarily because the defense can not move into position to meet the strategy of the offense. Therefore, it is the rule of this game that downs are alternated in order that each team has an immediate opportunity to counter its opponent's moves.

If a team loses a down, of course, there is a distinct advantage to its opponent. This happens, in accordance with the present invention, in two distinct ways. The drawing of a card which calls for a loss of down has already been discussed. A second means of loss of down is by rolling dice out of bounds. Otherwise stated, when one of the die comes to rest, after being rolled, outside the boundary of the playing field, the play is declared to be out of bounds at the line of scrimmage, and the down is lost.

As previously indicated, a player is "tackled" when a defensive player is able to advance to the same yard line as an offensive player, and FIG. 4C is illustrative of this principal. Thus, by keeping a few good men to the rear, the goal line can be defended. Indeed, if the defense can be spread out in five yard increments, the chances of tackling an advancing player is greatly increased.

There is yet another facet of the game to be explored. A player can score a touchdown by advancing over the goal line of his opponent. To accomplish this, however, unlike scores achieved through game card options, the correct number on the dice must be thrown. Otherwise stated, an offensive player on the eight yard line may advance only if the number on the dice is eight. He can, of course, advance any lesser number at the player's option, but can only score if the correct number is thrown.

Finally, due to the logistics involved, teams do not change ends at the end of each quarter, or at the half. Since wind and sun are not factors in this game, or at least in the normal course of things, there is simply no need to even the playing field in that fashion. At the beginning of the second half, the players may elect to roll dice to see who goes on offense first, or they may simply allow the team that lost the roll at the beginning to go on offense at the beginning of the second half.

Unlike play in the game of football, there is no advantage in going on defense at the beginning of a period, so the election given to the team that wins the coin toss under the rules of the game will invariably choose to go immediatly on offense.

If the game is tied at the end of regulation, there will be a sudden death overtime, and the players may elect to leave the board as it is at the end of regulation, or start from the initial playing position.

Having described a preferred embodiment of the present invention, what is claimed is:

1. Apparatus for use by two or more players for playing a board type game which simulates the game of football, comprising, in combination:

A game board, said game board having emblazoned thereon a depiction of a football playing field, including opposed 50 yard sections, a goal line at one end of each said section, an end zone section adjacent said goal line, and being further divided by yard stripes;

means defining a penalty zone, said penalty zone inscribing the width of said playing field, and having a defined length, said penalty zone being disposed at the center of the playing field and separating said opposed 50 yard sections;

means defining goal posts on the end line of each 50 yard section;

a plurality of statuettes, said statuettes representing players, one-half of said statuettes being of one color, and the remaining half being of a contrasting color;

means for arbitrarily selecting the order and nature of play;

optionally selectable means for providing alternate play opportunities;

said penalty zone adapted to receive statuettes, asid statuettes representing players, to thereby hold them from the field of play in accordance with the rules of play;

a missile, said missile being generally roundish in cross section, while more triangular in profile, said missile being digitally projectable through the air to present certain scoring opportunities; and means for timing plays and play periods in a manner similar to those of the game of football.

2. The apparatus as set forth in claim 1, wherein:

said goal posts are removably inserted into said game board, and said game board has receptacles for the receipt thereof.

3. The apparatus as set forth in claim 1, wherein:

said means for arbitrarily selecting the order of play comprises at least two dice.

4. The apparatus as set forth in claim 1, wherein: said means for arbitrarily selecting the order and nature of play comprises two sets of matched pairs of dice in which each said set bears the color of players they represent.

5. The apparatus as set forth in claim 2, wherein:

said means for arbitrarily selecting the order of play comprises at least two dice.

6. The apparatus as set forth in claim 2, wherein:

said means for arbitrarily selecting the order and nature of play comprises two sets of matched pairs of dice in which each said set bears the color of players they represent.

7. The apparatus as set forth in claim 1, wherein:

said optionally selectable means for alternate play opportunities comprises a deck of specially inscribed cards, each of said cards being optionally selectable to provide an alternative to the play that would otherwise have been dictated by the roll of the dice.

8. The apparatus as set forth in claim 2, wherein:

said optionally selectable means for alternate play opportunities comprises a deck of specially inscribed cards, each of said cards being optionally selectable to provide an alternative to the play that would otherwise have been dictated by the roll of the dice.

9. The apparatus as set forth in claim 3, wherein:

said optionally selectable means for alternate play opportunities comprises a deck of specially inscribed cards, each of said cards being optionally selectable to provide an alternative to the play that would otherwise have been dictated by the roll of the dice.

10. The apparatus as set forth in claim 1, wherein:

said missile comprises a rounded in cross section tri-cornered projectile capable of being held upright on said board by a player's finger and flicked with a finger to propel said projectile through one of said goal posts.

11. The apparatus as set forth in claim 2, wherein:

said missile comprises a rounded in cross section tri-cornered projectile capable of being held upright on said board by a player's finger and flicked with a finger to propel said projectile through one of said goal posts.

12. The apparatus as set forth in claim 3, wherein:

said missile comprises a rounded in cross section tri-cornered projectile capable of being held upright on said board by a player's finger and flicked with a finger to propel said projectile through one of said goal posts.

13. The apparatus as set forth in claim 7, wherein:

said missile comprises a rounded in cross section tri-cornered projectile capable of being held upright on said board by a player's finger and flicked with a finger to propel said projectile through one of said goal posts.

14. The method by which two or more players may play a board game which simulates football, and in which there is a board which simulates a football playing field, a penalty zone, said penalty zone separating 50-yard sections; each 50-yard section terminating in a goal line, and having an end zone beyond said goal line, goal posts disposed at the end of said end zone opposite said goal line, eleven movable game pieces to a team, dice to determine the nature and order of play, cards having play options displayed thereon, a timer to time periods of play and play times, and a projectable missile to simulate the ball itself; the steps of:

upon choosing up teams, players are strategically located on the playing field;

shaking the dice to determine order of play, alternately shaking the dice thereafter to determine how far a player can be advanced, if doubles show on the dice, having the option of moving a player, or selecting a card, whereby the play specified on said card may be executed on a player's next turn as an alternative to shaking the dice, removing an opposing player to a penalty zone by landing on the same yard stripe occupied by said opposing player, each said player in said penalty area being eligible to get out of said penalty zone, as an alternative play when his team shakes a doubles on said dice, scoring a touchdown by advancing a player over the opponent's goal line, and kicking an extra point by flicking the missile through the goal posts with one's finger.

15. The method as described in claim 14, including the additional step of attempting a field goal, said attempt being initiated by playing a field goal card, and thereafter attempting to propel the missile through said goal post.

16. The method as described in claim 14, including the further step of timing the periods of play, as well as the intervals between each play.

17. The method as described in claim 14 wherein the boundaries of the playing field are deemed to be inbounds and beyond said boundaries, out of bounds, and a play is lost if a die falls out of bounds when shaken.

18. The method as described in claim 15, including the further step of timing the periods of play, as well as the intervals between each play.

19. The method as described in claim 15, wherein the boundaries of the playing field are deemed to be inbounds and beyond said boundaries, out of bounds, and a play is lost if a die falls out of bounds when shaken.

20. The method as described in claim 15, wherein the boundaries of the playing field are deemed to be inbounds and beyond said boundaries, out of bounds, and a play is lost if a die falls out of bounds when shaken.

21. The method as described in claim 15, wherein each field goal attempt is made from behind the end zone of the player making such attempt.

* * * * *